US008205644B2

(12) United States Patent
Ueda

(10) Patent No.: US 8,205,644 B2
(45) **Date of Patent: *Jun. 26, 2012**

(54) INDUSTRIAL TWO-LAYER FABRIC

(75) Inventor: Ikuo Ueda, Fuji (JP)

(73) Assignee: Nippon Filcon Co., Ltd., Tokyo (JP)

( * ) Notice: Subject to any disclaimer, the term of this patent is extended or adjusted under 35 U.S.C. 154(b) by 223 days.

This patent is subject to a terminal disclaimer.

(21) Appl. No.: 12/733,482

(22) PCT Filed: Oct. 6, 2008

(86) PCT No.: PCT/JP2008/068175

§ 371 (c)(1),
(2), (4) Date: Mar. 3, 2010

(87) PCT Pub. No.: WO2009/044913

PCT Pub. Date: Apr. 9, 2009

(65) Prior Publication Data

US 2010/0196670 A1 Aug. 5, 2010

(30) Foreign Application Priority Data

Oct. 5, 2007 (JP) ..... 2007-261691

(51) Int. Cl.
*D21F 1/10* (2006.01)
*D21F 7/08* (2006.01)
*D03D 25/00* (2006.01)

(52) U.S. Cl. ..... 139/383 A; 139/383 AA; 139/383 R; 162/358.2

(58) Field of Classification Search ..... None
See application file for complete search history.

(56) References Cited

U.S. PATENT DOCUMENTS

| | | | | | |
|---|---|---|---|---|---|
| 3,603,354 | A | * | 9/1971 | Lee et al. | 139/383 A |
| 4,640,741 | A | * | 2/1987 | Tsuneo | 162/202 |
| 4,813,156 | A | * | 3/1989 | Ashworth et al. | 34/116 |
| 4,943,476 | A | * | 7/1990 | Sokaris | 442/187 |
| 5,343,896 | A | * | 9/1994 | Schroder et al. | 139/383 A |
| 5,366,798 | A | * | 11/1994 | Ostermayer | 442/207 |
| 5,421,375 | A | * | 6/1995 | Praetzel | 139/383 A |
| 5,437,315 | A | * | 8/1995 | Ward | 139/383 A |
| 5,449,026 | A | * | 9/1995 | Lee | 139/383 A |
| 5,454,405 | A | * | 10/1995 | Hawes | 139/383 A |
| 5,482,567 | A | * | 1/1996 | Barreto | 139/383 A |
| 5,544,678 | A | * | 8/1996 | Barrett | 139/383 A |
| 5,632,310 | A | * | 5/1997 | Yasuoka | 139/383 A |
| 5,709,250 | A | * | 1/1998 | Ward et al. | 139/383 A |

(Continued)

FOREIGN PATENT DOCUMENTS

EP 1 659 212 5/2006

(Continued)

*Primary Examiner* — Bobby Muromoto, Jr.
(74) *Attorney, Agent, or Firm* — Flynn, Thiel, Boutell & Tanis, P.C.

(57) ABSTRACT

An industrial two-layer fabric constituted by at least one upper surface side warp to be woven with at least one upper surface side weft, at least one lower surface side warp to be woven with at least one lower surface side weft, and at least one warp binding yarn to be woven with the at least one upper surface side weft and the at least one lower surface side weft having at least one pair of upper and lower warps in which the upper and lower surface side warps are located to be upper and lower, respectively, and at least one pair of warp binding yarns in which at least one yarn constitutes a warp binding yarn.

6 Claims, 5 Drawing Sheets

U.S. PATENT DOCUMENTS

| | | | | |
|---|---|---|---|---|
| 5,713,397 | A * | 2/1998 | Quigley | 139/383 A |
| 6,207,598 | B1 * | 3/2001 | Lee et al. | 442/206 |
| 6,585,006 | B1 * | 7/2003 | Wilson et al. | 139/383 A |
| 7,357,157 | B2 * | 4/2008 | Ueda | 139/383 A |
| 7,426,943 | B2 * | 9/2008 | Ueda et al. | 139/383 A |
| 7,484,537 | B2 * | 2/2009 | Ueda | 139/383 A |
| 7,874,322 | B2 * | 1/2011 | Ueda | 139/383 A |
| 2004/0182465 | A1 * | 9/2004 | Ward | 139/383 A |
| 2005/0103397 | A1 * | 5/2005 | Quigley et al. | 139/383 A |
| 2006/0096653 | A1 * | 5/2006 | Eagles | 139/383 A |
| 2006/0102244 | A1 * | 5/2006 | Ueda et al. | 139/383 A |
| 2006/0260708 | A1 | 11/2006 | Ueda et al. | |
| 2006/0278297 | A1 * | 12/2006 | Ueda | 139/383 A |
| 2007/0095147 | A1 | 5/2007 | Kikuiri et al. | |
| 2007/0095416 | A1 * | 5/2007 | Ueda | 139/383 A |
| 2008/0035231 | A1 * | 2/2008 | Hay et al. | 139/420 B |
| 2008/0169040 | A1 * | 7/2008 | Barrett | 139/383 A |
| 2008/0261475 | A1 * | 10/2008 | Eagles | 442/207 |
| 2008/0264511 | A1 * | 10/2008 | Boeck | 139/383 A |
| 2010/0221499 | A1 * | 9/2010 | Ueda | 428/172 |

FOREIGN PATENT DOCUMENTS

| | | |
|---|---|---|
| EP | 1 724 382 | 11/2006 |
| EP | 1 780 319 | 5/2007 |
| JP | 2006-144145 | 6/2006 |
| JP | 2006-322109 | 11/2006 |
| JP | 2007-119965 | 5/2007 |

* cited by examiner

INDUSTRIAL TWO-LAYER FABRIC

TECHNICAL FIELD OF THE INVENTION

The present invention relates to an industrial two-layer fabric and, in particular, relates to the industrial two-layer fabric which exhibits good fiber supportability and good surface smoothness while causes no decrease of its rigidity.

BACKGROUND ART

Fabrics obtained by weaving warps and wefts have conventionally been used widely as an industrial fabric. They are, for example, sued in various fields including papermaking wires, conveyor belts and filter cloths and are required to have fabric properties suited for the intended use or using environment. Of such fabrics, a papermaking wire used in a papermaking step for removing water from raw materials by making use of the network of the fabric must satisfy a severe demand. There is therefore a demand for the development of fabrics which do not transfer a wire mark of the fabric and therefore have excellent surface property, have enough rigidity and therefore are usable desirably even under severe environments, or are capable of maintaining conditions necessary for making good paper for a prolonged period of time. In addition, fiber supporting property, improvement in a paper making yield, good water drainage property, wear resistance, dimensional stability and running stability are demanded. In recent years, owing to the speed-up of a paper making machine, requirements for papermaking wires become severe further.

Since most of the demands for industrial fabrics and solutions thereof can be understood if papermaking fabrics on which the most severe demand is imposed among industrial fabrics will be described, the present invention will hereinafter be described by used of the papermaking fabric as a representative example.

Recently, particularly excellent hydration property and surface smoothness have been required due to the high speed operation of a machine for fabric. The Patent Publication 1 discloses a fabric for papermaking which improves hydration property by the fact that the number of upper surface side warps is set to be less than that of lower surface side warps. According to this fabric, longitudinally extending grooves are formed on the upper surface side to improve hydration property, since the number of the upper surface side warps is less. However, said fabric gets easily longitudinally lengthened, since the rigidity in the longitudinal direction of the fabric becomes lowered because of the small number of the upper surface side warps. Thus, said fabric has not been applied to an industrial fabric.

In addition, in the papermaking process, since the upper surface side serves to receive the raw material and serves as a surface contacting wet paper, the fiber supportability and the surface smoothness are required. In this respect, technical problems which cause the fact that the raw material is pulled, or that marks are attached to the paper cannot be solved simply by decreasing the number of the upper surface side warps.

Patent Publication 1: Japanese Patent Laid-open Publication 2005-350844

DISCLOSURE OF THE INVENTION

Technical Problems to be Solved by Present Invention

The object of the present invention is to provide an industrial two-layer fabric which is capable of exhibiting good air permeability, good fiber supportability, good surface smoothness, and high rigidity by providing longitudinally extending grooves on its upper surface side through a weave design.

Means to Solve Technical Problems

The technical feature of the industrial two-layer fabric according to the present invention lies in the fact that longitudinally extending grooves are formed on its upper surface side through a weave design without decreasing the number of the warps. Such a structure allows for good hydration property and good air permeability. Since such a structure can increase the shooting count of wefts, a fine surface can be obtained, so that the surface smoothness can be improved. In addition, for instance, in a case where the design on the upper surface side is defined by a plain weave design, a fiber supportability can be improved due to the fact that a distance between adjacent upper surface side warps constituting a plain weave design can be long because of the existence of the longitudinal grooves, and that a length of a crimp of the upper surface side warp can be long as compared to a normal fabric of a plain weave design, whereby the shooting count of wefts can be increased.

In order to solve the above technical problems, the present invention is defined by the following elements.

(1) The present invention provides an industrial two-layer fabric constituted by at least one upper surface side warp to be woven with at least one upper surface side weft, at least one lower surface side warp to be woven with at least one lower surface side weft, and at least one warp binding yarn to be woven with the at least one upper surface side weft and the at least one lower surface side weft comprising at least one pair of upper and lower warps in which said upper and lower surface side warps are located to be upper and lower, respectively, and at least one pair of warp binding yarns in which at least one yarn constitutes a warp binding yarn, characterized in that all or a portion of said upper surface side warps constituting said pair of upper and lower warps constitutes incomplete upper surface side warps in which a portion of knuckles are absent on the upper surface side, said pair of warp binding yarns are arranged so as to be adjacent to said incomplete upper surface side warps, all knuckles emerging on the upper surface side formed by said warp binding yarns and/or said upper surface side warps of said pair of warp binding yarns complements a portion where said knuckles of said incomplete upper surface side warps are absent.

(2) According to another preferred configuration, said incomplete upper surface side warps define a design in which two knuckles are absent in a complete design of the fabric.

(3) According to another preferred configuration, said portion of said incomplete upper surface side warps where said knuckles are absent is complemented by one pair of the warps located to be one side adjacent thereto.

(4) According to another preferred configuration, the industrial two-layer fabric according to claim 1 or claim 2, wherein The industrial two-layer fabric according to claim 1 or claim 2, wherein said portion of said incomplete upper surface side warps where said knuckles are absent is complemented by two pairs of the warps each pair located to be a respective side adjacent thereto.

(5) According to another preferred configuration, said portion of said incomplete upper surface side warps adjacent to said pair of the warp binding yarns where said knuckles are absent is complemented by one or both of two warps constituting said pair of the warp binding yarns.

(6) According to another preferred configuration, said warp binding yarns define a design in which one knuckle is formed on said upper surface side, or no less than two knuckles which are spaced apart from each other with a distance corresponding to no less than one upper surface side weft are formed on said upper surface side.

The warps constituting the fabric of the present invention comprises the upper surface side warps to be woven with the upper surface side wefts, the lower surface side warps to be woven with the lower surface side wefts, and the warp binding yarns to be woven with the upper and lower surface side wefts.

The upper and lower surfaces side warps are located to be upper and lower, respectively, to form a pair of upper and lower warps. In addition, the warp binding yarns form a pair of the warp binding yarns in which two warp binding yarns are disposed to be adjacent to each other so as to form an intersection, or a pair of the warp binding yarns consisting of one warp binding yarn and one lower surface side warp, or a pair of the warp binding yarns consisting of one warp binding yarn and one upper surface side warp. With respect to the warp binding yarns, any pair of the above may be arranged.

Further, incomplete upper surface side warps in which a portion of the knuckles are absent on the upper surface side are arranged on the upper surface side warps. The fact that a portion of knuckles are absent means that, in case of a plain weave design, the warp passes over one weft and then passes under three wefts, and then passes over one wefts, for instance, despite the fact that the warp normally passes over one weft and then passes under one weft in an alternate manner. In such a case, one knuckle is absent. A knuckle is defined to be a woven portion formed on a surface of a fabric which is bent along a weft at a position where a warp passes over or under one (or two) weft(s).

In addition, a pair of warp binding yarns is arranged on at least one side of the incomplete upper surface side adjacent thereto, the warp binding yarn or the upper surface side warp of the pair of the warp binding yarns passes over the upper surface side weft to form a knuckle in order to complement the absent knuckles of the incomplete upper surface side warp. In the incomplete upper surface side warps, at least one knuckle is absent on the upper surface side, and this is complemented by the warp binding yarn arranged to be adjacent thereto, or the upper surface side warp, or the warp binding yarns and the upper surface side warp. A longitudinally extending groove is formed between the upper surface side warps, since the complementing warp binding yarns and the upper surface side warp get close to the complete upper surface side warp at the portion where they emerge on the surface.

Not only the incomplete upper surface side warps, but also the complete upper surface side warp constituting a complete design of the warp may be arranged on the upper surface said layer. The complete upper surface side warp is defined to be a repetition of a fixed pattern without an absence of knuckles.

With respect to the incomplete upper surface side warp, if too less knuckles are formed on the surface, a distance between the upper surface side weft and the lower surface side weft becomes large, so that the easily deformable fabric the rigidity of which is deteriorated is formed because of the fact that the number of the intersections is decreased. Such being the case, it is preferable that the design on the upper surface side be the one in which comparatively many intersections are included such as the plain weave design, etc. The number of the absent knuckles in the complete design may be preferably two, since two warp binding yarns, or the warp binding yarn and the upper surface side warp, or one warp binding yarn complements the portion where the knuckles are absent.

With respect to other design on the upper surface side, there may be a design in which the warp binding yarn passes over two upper surface side wefts and then passes under two upper surface side wefts. Further, the design in which the incomplete upper surface side warp is complemented by the warp binding yarns may be a plain weave design, while the design in which the complete upper surface warp is formed may be other designs.

The design of the warp binding yarn may preferably be the one in which a portion passing over one or two upper surface side warp(s) and a portion passing under one or more lower surface side weft(s) are included. If too many warp binding yarns emerge on the upper surface side, it is necessary to increase the portions where the knuckles are absent on the incomplete upper surface side warp, and it is difficult for the warp binding yarns to get close to the incomplete upper surface side warp. That is why too many warp binding yarns are not preferable. It may be preferable that the warp binding yarns constitute the design in which a portion passing over one, or two at most upper surface side wefts is formed once or twice. For instance, the design in which two knuckles spaced apart from each other with a distance corresponding to one or more of the upper surface side weft(s) may be formed.

The lower surface side layer may be so arranged as not to destroy the design of other lower surface side warp. The number of the portion passing under one lower surface side weft may be plural, or the portion passing under the lower surface side weft adjacent to the warp binding yarns may be included.

The warp binding yarn may be woven with the upper surface side weft to form a knuckle, and then go down to the lower layer to be woven with the lower surface side weft, and then may be woven with the upper surface side weft again. A large inner space can be formed in the fabric, so that sufficient drainage property and good air permeability can be obtained because of such a design.

With respect to the design of the upper surface side warp cooperating with the warp binding yarn to form a pair, it may be preferable that one or two portions passing over one or two upper surface side weft(s) be provided, like the warp binding yarn. The upper surface side warp complements a portion where knuckles are absent on the incomplete upper surface side warp, too, so that it cooperates with the warp binding yarn to form a pair, and thus, the upper surface side warp may be determined in view of the design of the upper surface side.

Since the warp binding yarn complements a portion where the knuckles are absent on the incomplete upper surface side warp, a pair of the warp binding yarns may be arranged on at least one side of the incomplete upper surface side warp adjacent thereto, or may be arranged on both sides adjacent thereto. It is preferable that the pair of the warp binding yarns and the pair of the incomplete upper surface side warps be alternately arranged.

As to examples of the complementing, a portion where the knuckles are absent on the incomplete upper surface side warps may be complemented by one pair of the warps arranged on one side adjacent thereto, as shown in FIG. 7, or by two pairs of the warps each of which pairs is arranged on one of sides adjacent thereto, as shown in FIGS. 1,3, and 5, or by both of the two warps constituting a pair of the warp binding yarns, as shown in FIGS. 1 and 3, or by one of the two warps constituting a pair of the warp binding yarns.

The pair of the warp binding yarns is defined by two warp binding yarns, or by one warp binding yarn and one upper surface side warp, or by one warp binding yarn and one lower surface side warp, and the warp binding yarn(s) and the upper surface side warp serve as the complementing yarn.

Now, a principle in which a longitudinal groove is formed between the upper surface side warps by the fact that the knuckles of the warp binding yarn or the upper surface side warp shift to portions where the knuckles are absent on the incomplete upper surface side warp to complement the design is explained about.

In the upper surface side layer, if a space where the knuckles are absent on the upper surface side warp is generated, a phenomenon in which the knuckles of the warp binding yarns are caused to shift to embedded such a space occurs due to the fact that yarns tend to become uniform. In addition, such a shift of the knuckles of the warp binding yarns readily occurs, since a force to back up the shift of the knuckles of the warp binding yarns is generated.

The force to back up the shift of the knuckles is the one which is generated when two knuckles of the warps diagonally adjacent to each other repel each other. In the two knuckles of the warps diagonally adjacent to each other, one knuckle is formed on one upper surface side weft by one warp, while the other knuckle is formed on another upper surface side adjacent to the one upper surface side weft by another warp adjacent to the one warp.

For instance, as shown in FIG. 10, in a case where two warps and two wefts cross in such a way that the weft 4 passing over the warp 1 to which a tension force is applied passes under the warp 2 adjacent to the warp 1, while the wefts passing over the warp 2 passes under the warp 1, the weft 4 is caused to be pushed up at a portion where the weft 4 and the warp 1 cross to form a mountain, while a valley is formed at a portion where the weft 4 passes under the warp 2. On the other hand, the weft 3 is caused to be pushed up at a portion where the weft 3 and the warp 2 cross to form a mountain, while a valley is formed at a portion where the weft 3 passes under the warp 1. Such being the case, since the warp at the valley tends to shift so as to be away from the mountain due to the fact that the positional relationship between the warp and the weft is set to be reverse in the vertical direction at four cross points each of which point is defined by either of two warps adjacent to each other and either of two wefts adjacent to each other, the warps 1 and 2 adjacent to each other tend to shift so as to be away from each other (refer to arrows in FIG. 10). This is why the repelling force is generated. The repelling force causes the knuckles of the warp binding yarns or the upper surface side warps to shift to any position, whereby a longitudinally extending groove is formed.

With respect to a diameter of the yarn constituting the fabric, it is preferable that the upper surface side warp as well as the upper surface side weft include a comparatively small diameter in order to render the upper surface fine and smooth. It is preferable that the diameter of the warp binding yarn be the same as that of the upper surface side warp in order for the warp binding yarn to complement the design of the upper surface side design. With respect to the weft, the diameter of the upper surface side weft is preferably set to be comparatively small in order to render the upper surface side layer fine. In addition, since the lower surface side layer serves to contact a roll of a machine, so that high rigidity and wear resistance are required for the lower surface side layer, it is preferable that the diameter of the lower surface side weft be comparatively large. Further, the diameters of the upper surface side warp, the lower surface side warp, and the warp binding warp may be set to be the same, while the diameter of the only lower surface side warp may be large. A ratio of the upper surface side warps to the lower surface side wefts may be appropriately determined, such as 1:1, 2:1, 3:2, and 4:3. A latitudinal groove may be formed by setting the number of the lower surface side wefts to be less than that of the upper surface side wefts, and the hydration property and the drainage property can be even more improved by a combination of the latitudinal groove with the longitudinal groove.

No particular limitation is imposed on a yarn to be used in the present invention and it can be selected freely depending on the properties which an industrial fabric is desired to have. Examples of it include, in addition to monofilaments, multifilaments, spun yarns, finished yarns subjected to crimping or bulking such as so-called textured yarn, bulky yarn and stretch yarn, and yarns obtained by intertwining them. As the cross-section of the yarn, not only circular form but also square or short form such as stellar form, or elliptical or hollow form can be used. The material of the yarn can be selected freely and usable examples of it include polyester, polyamide, polyphenylene sulfide, polyvinylidene fluoride, polypropylene, aramid, polyether ketone, polyethylene naphthalate, polytetrafluoroethylene, cotton, wool and metal. Of course, yarns obtained using copolymers or incorporating or mixing the above-described material with a substance selected depending on the intended purpose may be used.

As the upper surface side warps, lower surface side warps, upper surface side wefts and warp binding yarns, use of a polyester monofilament having rigidity and excellent dimensional stability is usually preferred. When lower surface side wefts which need wear resistance are obtained by interweaving of polyester monofilaments and polyamide monofilaments while arranging them alternately, they are able to have wear resistance without losing rigidity.

It is also possible to place a plurality of yarns with the same design at a position where one yarn is normally placed from the standpoint of design. Design of a plurality of yarns having a thin diameter brings about improvement in surface property and thinning of the fabric.

Effect of the Invention

According to the present invention, an industrial two-layer fabric which exhibits good fiber supportability, good surface smoothness, high rigidity can be obtained by providing longitudinally extending grooves on an upper surface side through a weave design without decreasing the number of warps.

EXPLANATION OF SYMBOLS

1*u*, 3*u*: complete upper surface side warps
1*u*', 3*u*': incomplete upper surface side warps
2*u*", 4*u*": upper surface side warp cooperating with warp binding yarn to form a pair
2*b*, 4*b*: warp binding yarns
2B, 4B: warp binding yarns
2*d*, 4*d*: lower surface side warps
1'*u*, 2'*u* . . . 16'*u*: upper surface side wefts
1'*d*, 2'*d* . . . 15'*d*: lower surface side wefts

DETAILED DESCRIPTION OF THE INVENTION

Examples of the present invention will hereinafter be described based on accompanying drawings.

Figure 7:
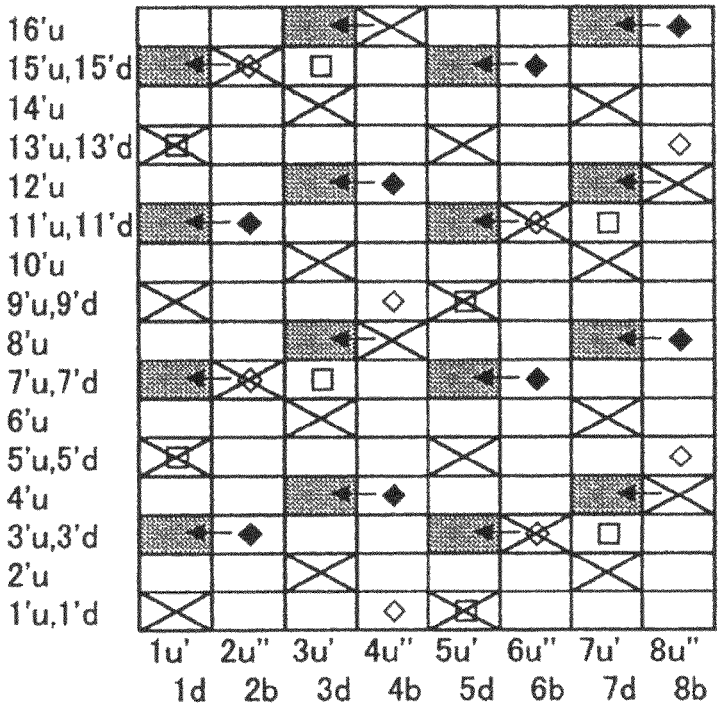
FIG. 7 is a design view showing a complete design of the fourth embodiment according to the present invention.
Figure 8:
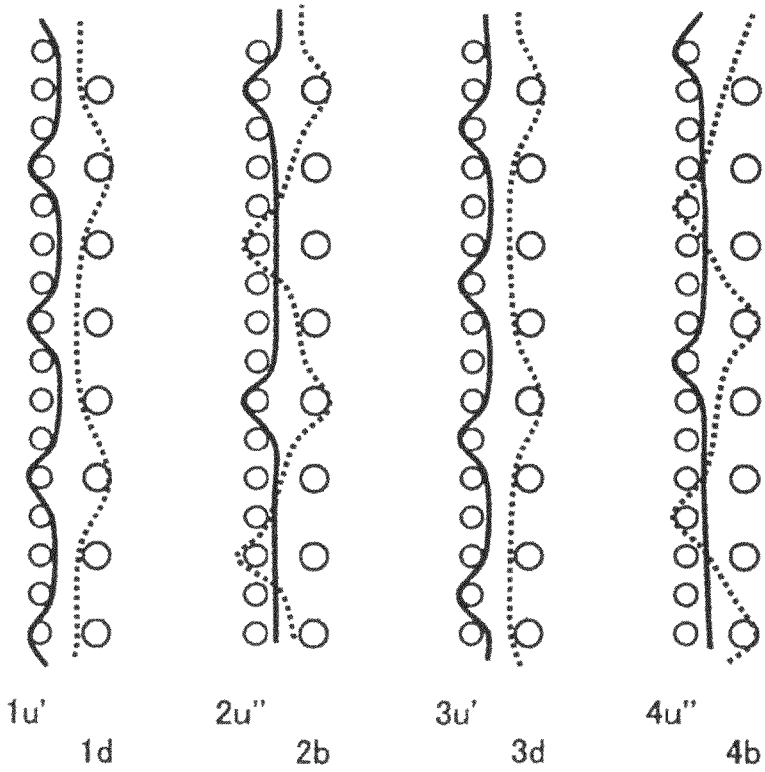
FIG. 8 is a cross section view taken along warps 1-4 of the fourth embodiment.
Figure 9:
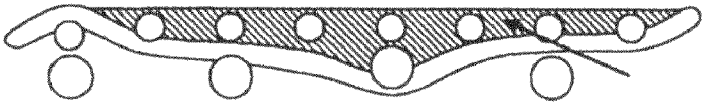
FIG. 9 is a view showing an inner space of the fabric formed by warp binding yarns.
Figure 10:
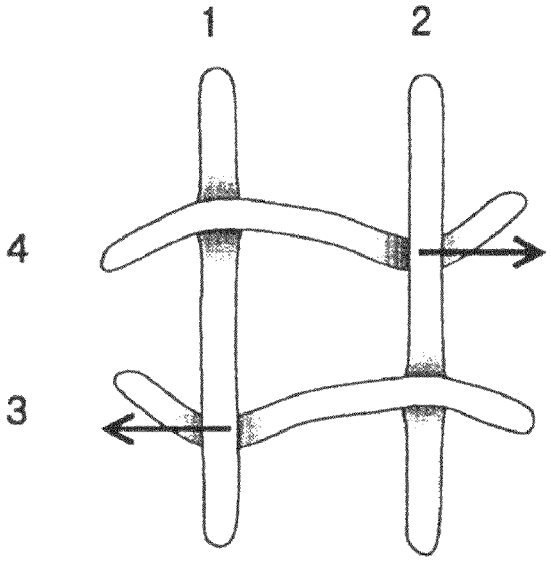
FIG. 10 is a view showing a principle by which a longitudinal groove is formed using two warps and two wefts adjacent to each other.

Each of FIGS. 1 to 9 is a view showing an embodiment of the present invention. Each of FIGS. 1, 3, 5, and 7 is a design view, while each of FIGS. 2, 4, 6, and 8 is a cross-sectional view of the warps 1 to 4. FIG. 9 is a view showing an inner space of the fabric formed by the warp binding yarns. FIG. 10 is a view showing intersections where the warps 1, 2 and the wefts 3, 4 cross. A principle in which longitudinal grooves are formed will be explained about with reference to FIG. 10.

The design diagram is a minimum repeating unit of a fabric design and a whole fabric design is formed by connecting this complete design longitudinally and latitudinally. In these design diagrams, warps are indicated by Arabic numerals, for example 1, 2, and 3. The complete upper surface side warp is indicated by the numeral to which "u" is attached, the incomplete upper surface side warp is indicated by the numeral to which "u'" is attached, the upper surface side warp to cooperate with the warp binding yarn to form a pair is indicated by the numeral to which "u"" is attached, the warp binding yarn is indicated by the numeral to which "b" is attached, the warp binding warp to cooperate with the warp binding yarn "b" to form a pair is indicated by the numeral to which "B" is attached, and the lower surface side warp is indicated by the numeral to which "d" is attached Further, there are cases where a pair of the upper and lower surface side warps consisting of the upper surface side warp (u,u') and the lower surface side warp (d), a pair of the warp binding yarns consisting of the upper surface side warp (u") and the warp binding yarn (b), a pair of the warp binding yarns consisting of two warp binding yarns (b, B), or a pair of the lower surface side warp (d) and the warp binding yarn (b) are included.

The wefts are indicated by Arabic numerals with a prime, for example, 1', 2' and 3'. There are a case where the upper surface side weft and the lower surface side weft are arranged on upper and lower, respectively, and a case where only the upper surface side wefts are arranged, in accordance with a ratio of the wefts. The upper surface side weft is indicated by the numeral to which "u" is attached, while the lower surface side weft is indicated by the numeral to which "d" is attached.

In the diagrams, a cross "X" means that an upper surface side warp lies over an upper surface side weft to form a knuckle, while an open square "□" indicates that a lower surface side weft lies under a lower surface side weft to form a knuckle. A solid rhombus "◆" indicates that a warp binding yarn lies over an upper surface side weft to form a knuckle. An open rhombus "◇" indicates that a warp binding yarn lies under a lower surface side weft to form a knuckle. A solid circle "●" indicates that a warp binding yarn lies under an upper surface side weft to form a knuckle, while an open circle "○" indicates that a warp binding yarn lies under a lower surface side weft to form a knuckle. An arrow in the design diagram indicates a portion where a knuckle of a warp binding yarn or an upper surface side warp complements an absent knuckle of an incomplete upper surface side warp.

Upper surface warps and wefts overlay lower surface side warps and wefts. In the design drawings, the lower surface side warps and wefts lie directly underneath the upper surface side warps and wefts, respectively. This is for the convenience of the drawings, and in an actual fabric, the lower surface side warps and wefts may biasedly lie under the upper surface side wraps and wefts. Since the warp binding yarns complement the knuckles which are absent on the incomplete warp to get close to the upper surface side warp, a longitudinal groove is formed there. This means that there is a big difference between the overlap portion in the real fabric and that in the design diagram.

First Embodiment

Figure 1:
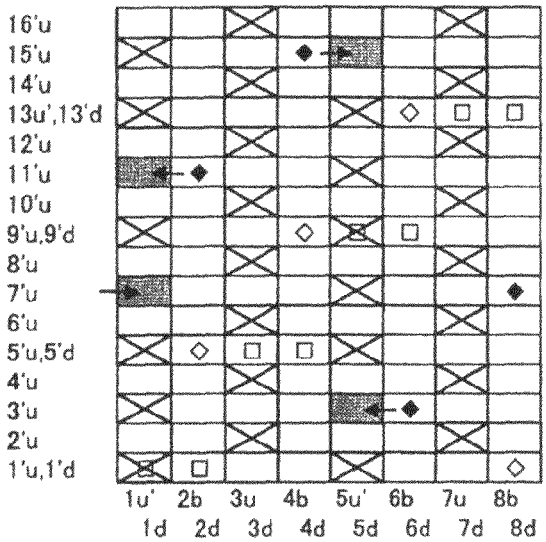
FIG. 1 is a design view showing a complete design of the first embodiment according to the present invention.
Figure 2:
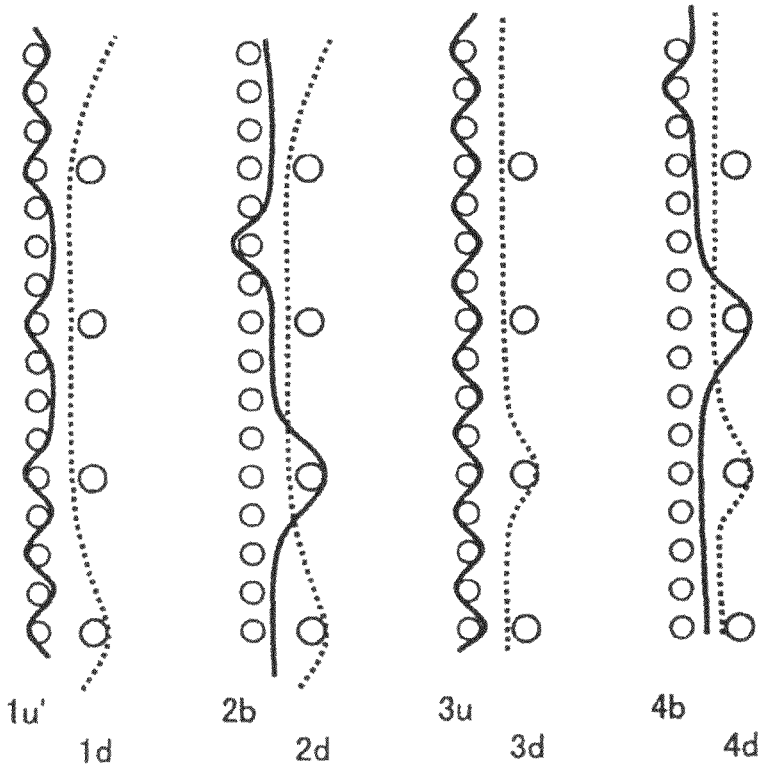
FIG. 2 is a cross section view taken along warps 1-4 of the first embodiment.

FIG. 1 is a design drawing of a fabric consisting of sixteen shafts or sixteen warps of an embodiment 1 of the present invention, and FIG. 2 is a cross sectional view along warps. One of warps 2, one of warps 4, one of warps 6, and one of warps 8 are warp binding yarns (b), and the other of warps 2, the other of warps 4, the other of warps 6, and the other of warps 8 are lower surface side warps (d). Each of warps 1, 3, 5, and 7 is a pair of upper surface side warps (u, u') and lower surface side warps (d), and the upper surface side warps 1, 5 are incomplete upper surface side warps u' and the upper surface side warps 3, 7 are a pair of upper and lower warps including complete upper surface side warps (u).

The incomplete upper surface side warps are a plain weave design with the absence of two knuckles, and a pair of warp binding yarns consisting of the warp binding yarn and the lower surface side warp is arranged on its both sides. In addition, by complementing a portion where knuckles of the incomplete upper surface side warps are absent with knuckles formed by the warps binding yarns arranged on its both sides, a plain weave design corresponding to one upper surface side warp is formed on its upper surface side.

More specifically, as shown in FIG. 2, the incomplete upper surface side warp 1 *u*' are a plain weave design where knuckles are absent on portions of the upper surface side wefts 7 *u*' and 11 *u*'. Further, the warp binding yarn 2*b* next to the incomplete upper surface side warps 1 *u*' are woven with the upper surface side weft 11' u to form a knuckle, which complements a portion where the knuckle is absent on the incomplete upper surface side warp 1 *u*'. Likewise, the warp binding yarn 8*b* is woven with the upper surface side weft 7' u to form a knuckle, which complements a portion where the knuckle is absent on the incomplete upper surface side warp 1 *u*'. This causes the warp binding yarns on both sides to come near to the incomplete upper surface side warp, whereby a longitudinally extending groove which is spaced apart from each other with an uniform distance is formed on the portion of each of the warps 2, 4, 6, and 8 on the design drawing.

In the first embodiment, two knuckles are absent in the incomplete upper surface warps. If too many knuckles are absent, intertwining portions with the upper surface side wefts becomes less, so that the rigidity decreases. This is applied to the upper surface side wefts. In addition, the fabric in this embodiment is based on the plain weave design, other deign such as a ⅓ design in which the number of the intertwining portions are less are not preferable, since the rigidity becomes insufficient for the same reason.

Further, the warp binding yarn is woven with the upper surface side weft to form a knuckle, and it goes down to a lower layer to be woven with the lower surface side weft, and then, it is woven with the upper surface side weft again. A large inner space is formed in the fabric, because of such a configuration, so that sufficient water drainage and air permeability are obtained (see FIG. 9).

In the lower surface side layer, the warp binding yarns arranged on both sides of the lower surface side warp along with the lower surface side warp pass under one lower surface side weft, while the lower surface side weft includes a structure in which five long crimps are formed on the lower surface side, so that high rigidity and good wear resistance are obtained.

Second Embodiment

Figure 3:
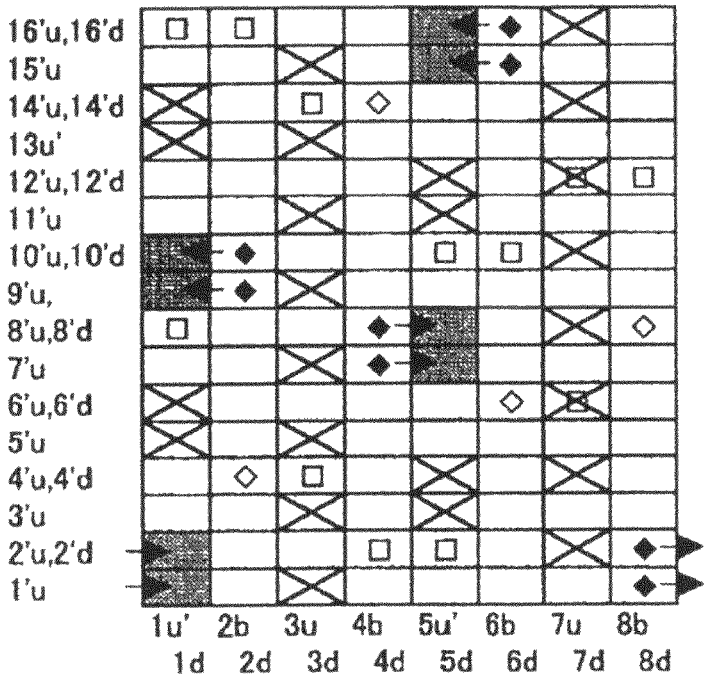
FIG. 3 is a design view showing a complete design of the second embodiment according to the present invention.
Figure 4:
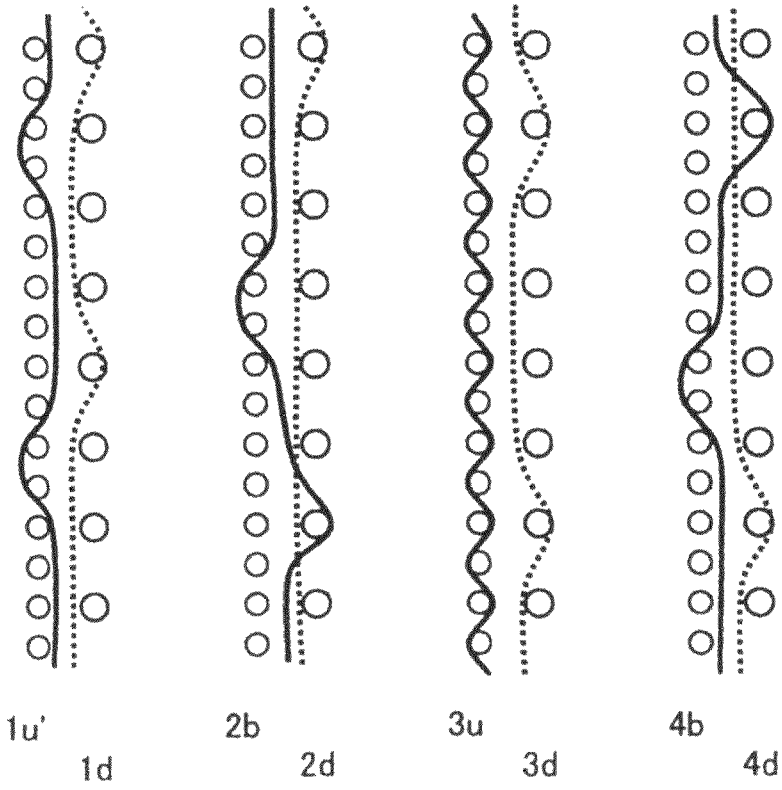
FIG. 4 is a cross section view taken along warps 1-4 of the second embodiment.

FIG. 3 is a design view showing a fabric consisting sixteen warps, or sixteen shafts of a second embodiment according to the present invention and FIG. 4 is a cross sectional view taken along warps. The arrangement of the warps is the same as that of the first embodiment.

In an upper surface side layer, a design in which one warp passes over two upper surface side wefts and passes under two upper surface side wefts and a plain weave design are alternately arranged. More specifically, a 2/2 design is formed on the upper surface side by a combination of warp binding yarns (b) with incomplete upper surface side warps (u'), while the plain weave design is formed by the complete upper surface side warps (u).

In the incomplete upper surface side warps (u'), two knuckles, each passing over two successive upper surface side wefts, are absent, and a pair (b, d) of the warp binding yarns consisting of one warp binding yarn and one lower surface side warp is arranged on its both sides. In addition, the 2/2 design corresponding to one of the upper surface side warp is formed on the upper surface side by complementing a portion where a knuckle of the incomplete upper surface side warp is absent with a knuckle of formed by the respective warp binding yarns (b) arranged on its both sides.

Like this embodiment, the warp binding yarns (b) may pass over two successive upper surface side wefts to form a knuckle, in other words, the upper surface side may be constituted by two kinds of warp designs.

The lower surface side layer includes a zigzag design in which two warp binding yarns each of which is adjacent to one of sides of one lower surface side warp pass under the lower surface side weft under which the lower surface side warp passes in an alternate manner, so that good wear resistance and high rigidity are obtained because the lower surface side wefts define long crimps.

Third Embodiment

Figure 5:
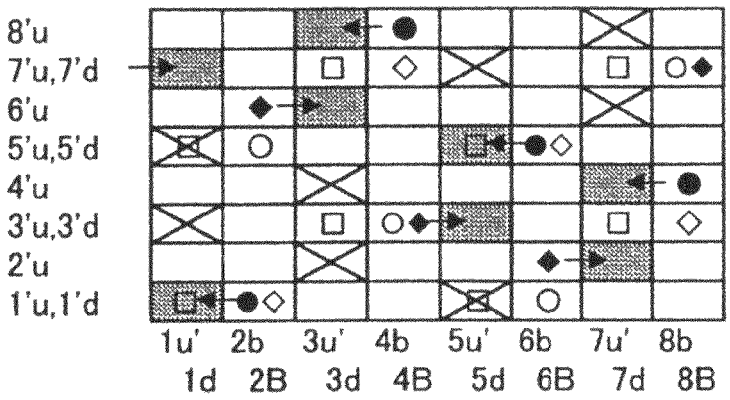
FIG. 5 is a design view showing a complete design of the third embodiment according to the present invention.
Figure 6:
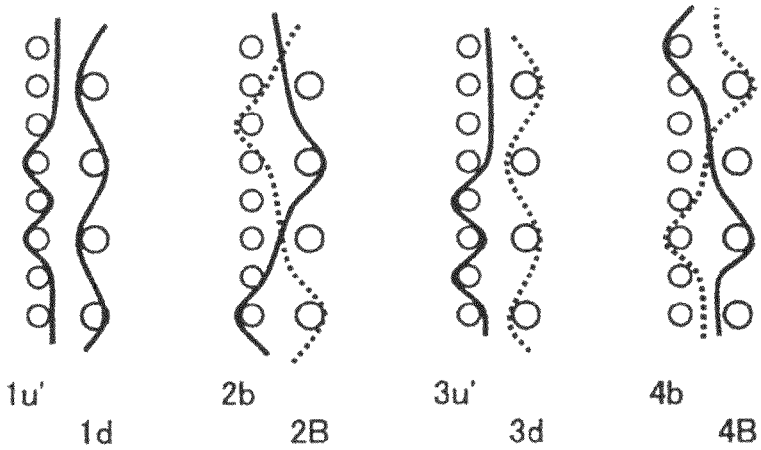
FIG. 6 is a cross section view taken along warps 1-4 of the third embodiment.

FIG. 5 is a design view showing a fabric of a third embodiment according to the present invention and FIG. 6 is a cross sectional view taken along warps. In this embodiment, like the first embodiment, in the upper surface side, a plain weave design with sixteen shafts are adopted, but complete upper surface side warps (u) forming a complete plain weave design on the upper surface side do not exist, all the upper surface side warps define incomplete upper surface side warps (u') instead.

In the first and second embodiments, a pair of warp binding yarns consisting of the warp binding yarn and the lower surface side warp is arranged, but, in this embodiment, a pair of warp binding yarns consisting of two warp binding yarns (b, B) is arranged instead.

The incomplete upper surface side warp defines a plain weave design in which two knuckles are absent, and the plain weave design corresponding to one upper surface side warp is formed on the upper surface side by complementing the portion where the knuckles are absent with the knuckles of the warp binding yarns arranged on its both sides.

More specifically, the incomplete upper surface side warp (3 *u*') defines a plain weave design in which knuckles are absent at the portions of the upper surface side wefts (6 *u*', 8 *u*'). In addition, a knuckle is formed by the warp binding yarn (2B) on the one side adjacent thereto being woven with the upper surface side weft (6' u), which complements a portion where the knuckle is absent on the incomplete upper surface side warp (3 *u*'). Likewise, a knuckle is formed by the warp binding yarn (4*b*) being woven with the upper surface side weft (8' u), which complements a portion where the knuckle is absent on the incomplete upper surface side warp (3 *u*').

Further, the incomplete upper surface side warp (5 *u*') defines a plain weave design in which knuckles are absent at the portions of the upper surface side wefts (3' u, 5' u). In addition, a knuckle is formed by the warp binding yarn (4B) on the one side adjacent thereto being woven with the upper surface side weft (3' u), which complements a portion where the knuckle is absent on the incomplete upper surface side warp (5 *u*'). Likewise, a knuckle is formed by the warp binding yarn (6*b*) being woven with the upper surface side weft (5' u), which complements a portion where the knuckle is absent on the incomplete upper surface side warp (5 *u*').

With respect to other portions, similar to the above, longitudinal grooves which are spaced apart from each other with a uniform distance are formed on a portion of the warps (2, 4, 6, 8).

In this embodiment, two warp binding yarns forming a pair are divided in a pair, so that one of the two warp binding yarns complements the absent portion of one incomplete upper surface side warp, while the other of the two warp binding yarns complement the absent portion of another incomplete upper surface side warp. In addition, like the above embodiment, since the warp binding yarn goes down to the lower layer to be woven with the lower surface side weft after it is woven with the upper surface side weft to form a knuckle, a large inner space is formed in the fabric, so that sufficient water drainage and good air permeability are obtained.

The lower surface side layer defines a ribbed design in which the lower surface side warp and the warp binding yarn which are adjacent to each other pass under the same lower surface side weft, so that high rigidity is obtained.

Fourth Embodiment

FIG. 7 is a design view showing a fabric of a fourth embodiment according to the present invention and FIG. 8 is a cross sectional view taken along warps. In this embodiment, like the first embodiment, in the upper surface side, a plain weave design with sixteen shafts are adopted, but the complete upper surface side warp (u') in which knuckles are absent is complemented with a knuckle formed by the upper surface side warp (u") arranged on the one side adjacent thereto and the warp binding yarn (b).

In this embodiment, the complete upper surface side warp (u) forming a complete plain weave design on the upper surface side does not exist, so that a pair of the warp binding yarns is defined by the warp binding yarn (b) and the upper surface side warp (u") instead.

The incomplete upper surface side warp (u') defines a plain weave design in which four knuckles are absent, so that the plain weave design corresponding to one upper surface side warp is formed on the upper surface side by complementing a portion where the knuckles are absent with the knuckles formed by the warp binding yarn arranged on one side adjacent thereto and the upper surface side warp.

More specifically, the incomplete upper surface side warp (1*u*') defines a plain weave design in which knuckles are absent at the portions of the upper surface side wefts (3' u, 7' u, 11' u, 15' u). In addition, a knuckle is formed by the warp binding yarn (2*b*) on the one side adjacent thereto being woven with the upper surface side wefts (3' u, 11' u), and a knuckle is formed by the upper surface side warp (2 *u*") being woven with the upper surface side wefts (7' u, 15' u), which complements the portion where the knuckles are absent on the incomplete upper surface side warp (1*u*'). Like the above embodiment wherein the knuckle on the incomplete upper surface side warp is complemented with the warp binding yarn arranged on its both sides, the design may be arranged by the warp binding yarn and the upper surface side warp which cooperates with the warp binding yarn to form a pair.

With respect to other portions, since the warp biding yarn (b) and the upper surface side warp (u") get close to the incomplete upper surface side warp (u'), a longitudinal groove is formed on the portions of each of the warps (2, 4, 6, 8) in the design drawing, grooves spaced apart from each other with an uniform distance are formed as a whole fabric.

As described above, the fabric which exhibits good dehydration property, good air permeability, good surface smoothness, good fiber supportability, and high rigidity can be obtained by forming longitudinally extending grooves on the upper surface side of the fabric through a combination of designs.

What is claimed is:

1. An industrial two-layer fabric constituted by at least one upper surface side warp to be woven with at least one upper surface side weft, at least one lower surface side warp to be woven with at least one lower surface side weft, and at least one warp binding yarn to be woven with the at least one upper surface side weft and the at least one lower surface side weft comprising at least one pair of upper and lower warps in which said upper and lower surface side warps are located to be upper and lower, respectively, and at least one pair of warp binding yarns in which at least one yarn constitutes a warp binding yarn, characterized in that all or a portion of said upper surface side warps constituting said pair of upper and lower warps constitutes incomplete upper surface side warps in which a portion of knuckles are absent on the upper surface side, said pair of warp binding yarns are arranged so as to be adjacent to said incomplete upper surface side warps, all knuckles emerging on the upper surface side formed by said warp binding yarns and/or said upper surface side warps of said pair of warp binding yarns complements a portion where said knuckles of said incomplete upper surface side warps are absent to form a hydrating groove.

2. The industrial two-layer fabric according to claim 1, wherein said incomplete upper surface side warps define a design in which two knuckles are absent in a complete design of the fabric.

3. The industrial two-layer fabric according to claim 1, wherein said portion of said incomplete upper surface side warps where said knuckles are absent is complemented by one pair of the warps located to be one side adjacent thereto.

4. The industrial two-layer fabric according to claim 1, wherein said portion of said incomplete upper surface side warps where said knuckles are absent is complemented by two pairs of the warps each pair located to be a respective side adjacent thereto.

5. The industrial two-layer fabric according to claim 1, wherein said portion of said incomplete upper surface side warps adjacent to said pair of the warp binding yarns where said knuckles are absent is complemented by one or both of two warps constituting said pair of the warp binding yarns.

6. The industrial two-layer fabric according to claim 1, wherein said warp binding yarns define a design in which one knuckle is formed on said upper surface side, or no less than two knuckles which are spaced apart from each other with a distance corresponding to no less than one upper surface side weft are formed on said upper surface side.

* * * * *